73-151
11/16/76 OR 3,991,610 SR

United States Patent [19]
Rakar et al.

[11] 3,991,610
[45] Nov. 16, 1976

[54] APPARATUS FOR CARRYING OUT UNDERGROUND MEASUREMENTS DURING DRILLING OF UNDERGROUND STRATA

[75] Inventors: Geza Rakar; Zoltan Toth; Istvan Zsoka, all of Budapest, Hungary

[73] Assignee: Koolaj-Es Foldgazbanyaszati Ipari Kutato Laboratorium, Budapest, Hungary

[22] Filed: Nov. 6, 1975

[21] Appl. No.: 629,634

[30] Foreign Application Priority Data

Nov. 8, 1974 Hungary ..... KO 2686

[52] U.S. Cl. ..... 73/151
[51] Int. Cl.[2] ..... E21B 97/00
[58] Field of Search ..... 73/151, 152, 155; 175/40, 50

[56] References Cited

UNITED STATES PATENTS 3,777,814 12/1973 Gastavson et al. ..... 73/151 X
3,872,721 3/1975 Ilfrey ..... 73/151

*Primary Examiner*—Jerry W. Myracle
*Attorney, Agent, or Firm*—Ernest F. Marmorek

[57] ABSTRACT

The invention concerns apparatus for performing underground measurements during drilling of underground strata using conventional measuring instruments. It comprises a closed instrument casing filled with oil, an adaptor coupling the casing to the drilling pipe, a spring holder connected to the instrument casing and carrying damping spring means, a helical plate controlling angular displacement and a piston-and-cylinder displacement control device, a first bore in the adaptor for conveying mud to a downward section of the drilling pipe, a second closable bore in the adaptor for permitting mud to flow from the annular space around the pipe through the instrument casing, and a closable bore in the instrument casing for communicating the pressure in the interior of the drilling pipe to the instrument casing.

6 Claims, 3 Drawing Figures

APPARATUS FOR CARRYING OUT UNDERGROUND MEASUREMENTS DURING DRILLING OF UNDERGROUND STRATA

The invention concerns apparatus which makes it possible to use conventional measuring and recording-/registering devices during drilling, e.g. during exploratory drilling for hydrocarbons, at the bottom of the borehole or indeed at any depth.

The invention seeks to provide apparatus which is, principally, suitable for the measurement and recordal/registration of the pressure of the flushing medium (mud) employed in the course of drilling, either in the drilling pipe or in the annular space defined between the pipe and the borehole or well. Additionally, the apparatus should be suitable for measuring the temperature in the drilling pipe, and for ensuring that other instruments should also become usable during drilling.

Hitherto the above-mentioned measurements and the use of conventional instruments have not been possible due to the deleterious influence on the operation and accuracy of the instruments exerted by the intensive vibrations generated by drilling.

In actual drilling it is important to know about changes in the pressure and temperature of the mud, especially when using more complex technology, or when experiencing difficulties with a given stratum, or a blow-out, or when deepening a very deep, high temperature borehole. From changes in these parameters conclusions or deductions may be made concerning the technology to be employed or the state of the borehole.

The intensive radial and tangential vibrations that arise in drilling make it normally impossible to use conventional pressure and temperature measuring instruments because the vibrations makes their functioning uncertain and the resulting charts or diagrams are virtually impossible to evaluate. For these reasons at present the pressure and temperature of a borehole can only be measured in static conditions, or if justifiable, during flushing. The carrying out of continuous measurements during drilling with existing instruments and without cables cannot be achieved.

It is known that purpose-built pressure or temperature measuring devices have been built into the drilling rod or pipe and the measurement results have then been continuously relayed by cable to ground level, the measuring current being passed down to the instrument(s) by cable also. While this is technologically satisfactory, it can only be used where there is a cable available (e.g. electric drilling) or where an electric cable is provided specially for this purpose. Apart from the not insignificant expense of the cable itself, there results a slowing down in the drilling process in that the problem of connecting and disconnecting the cable must be solved at the start-up and stoppage of the drilling, and when it is desired to add new sections to the drilling stem.

According to the present invention, there is provided apparatus for performing underground measurements during drilling of underground strata using conventional measuring instruments, comprising a closed instrument casing which in use is filled with a hydraulic fluid, an adaptor for coupling said casing to the drilling pipe, a spring holder connected to the instrument casing and carrying damping spring means, a member for controlling angular displacement and a hydraulic displacement control device, a first bore in the adaptor for permitting mud to flow downwardly around the outside of said casing, a second, closable bore in the adaptor for permitting mud to flow through the said casing, and a closable bore in the said casing for communicating external pressure to the interior of the said casing, said second bore and the bore in the said casing opening and closing in mutually opposite senses.

The invention thus makes it possible continuously to measure and record or register the pressure of the drilling mud in the drilling pipe or in the annular space, and the temperature of the drilling mud in the drilling pipe, by using commercially available pressure and temperature measuring instruments mounted at the desired measurement location (above the boring tool, weighting or ballast rod, drilling pipe). An appropriate combination of instruments makes the simultaneous performance of all three of the mentioned instruments possible. After demounting, the diagram or chart of the measurements may be evaluated in the usual manner.

The invention is described, by way of example only, with reference to the accompanying purely diagrammatic drawing, wherein.

Figure 1:
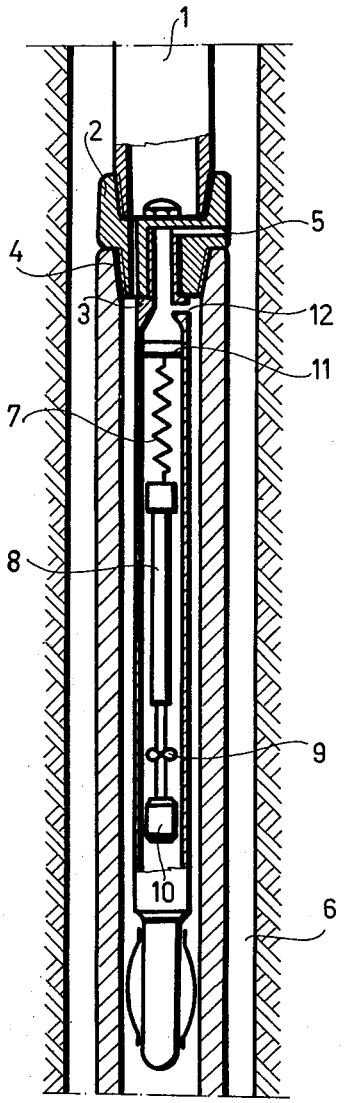
FIG. 1 is a sectional view of the apparatus according to the invention, for the measurement of mud pressure.

Referring first to FIG. 1, a drilling pipe 1 is connected by a threaded adaptor or coupling 2 to a closed, hollow instrument casing 3 disposed at the desired measurement location and filled with a hydraulic liquid, such as oil. The flushing (circulation) medium in use passes through bores 4 formed in the adaptor 2, and flows around the outside of the instrument casing 3 to the lower section of the drilling pipe. The interior of the instrument casing 3 is connected via another bore 5 which is closable by closing means such as screw 16 in threaded collar 17, in the adaptor 2 with the annular space 6 around the pipe, in which space it is desired to measure the pressure of the mud. In the instrument casing 3 there is a spring holder 11 on which a pressure measuring instrument 8 and its associated clockwork and recording/registering system are suspended by way of a damping spring 7. A closable bore 12 which may be threaded and closed, for example, by screw 18, is provided in the casing 3 to permit or prevent flow from the drilling pipe to the interior of the instrument casing 3. When the bore 12 is closed, the pressure measuring instrument 8 measures the pressure in the annular space 6. When the bore 12 is open, the bore 5 must be closed and then the instrument 8 measures the internal pressure of the drilling pipe. A helical plate 9 for controlling angular displacement and a hydraulic movement control device 10 are connected to the lower part of the pressure measuring instrument 8. The device 10 is in the form of a double-acting piston-and-cylinder unit provided with bores and with means for controlling the rate of flow of hydraulic liquid (oil) through the bores.

In operation, the instrument casing 3 rotates with the drilling pipe 1 and adaptor 2. The composite polar damping system, consisting of the damping spring 7, the helical plate 9 and the hydraulic movement control device 10, has the task of damping the vibrations of the drilling pipe and of the mud sufficiently to enable the pressure changes to be evaluated from the chart or diagram produced by the recording/registering instrument. This can be achieved according to the preferred embodiment of the invention by so adjusting the damping spring 7, in dependence on the weight of the instrument 8, that the spring extension should be onehalf of the operative length. Under the effect of axial displacement the length of the spring changes and the vibrations are damped. Correspondingly, the movement control device 10 is displaced in the oil and brakes the displacement of the instrument. This effect is regulated by the changes in the through-flow cross-sections in the piston.

The damping spring 7 damps the axial displacement by changing its length and thus the spring force, under the effect of radial displacement of the instrument, whereby to pull the latter back to its original position.

Control of angular displacement is effected by the specially formed helical plate 9 which causes the oil to be displaced in proportion to the magnitude of the angular displacement. This brakes the angular displacement and at the same time longitudinally displaces the spring 7, whereby to provide additional braking of the displacement.

A simplified mechanical model of the damping system may be stated as an oscillating movement damped by tensile forces proportional to velocity. The equation of the movement can be written, on the basis of a deviation or displacement due to an external axial force, and with strong damping, as $$X = e^{-k/2m\ t}\ (A_1 \cosh \mu t + A_2 \sinh \mu t)$$

wherein:

$X$ = deviation or displacement
$k$ = mechanical resistance
$m$ = mass
$t$ = time of test
$A_1$ = constant, derived from constants of integration
$A_2$ = constant, derived from constants of integration
$\mu = f\ (k,m,c)$, i.e., a function of $k$, $m$ and $c$
$c$ = mechanical spring constant.

The result for X results in three types of movement. The expedient type of movement is when, with the aid of the displacement controlling device (mechanical resistance), X is zero with regard to initial velocity, in the axial direction. Then the external exciting vibrations have little effect on the suspended, mechanically connected system of the measuring instrument and its recording/registering device, which system behaves in the main as a large inert mass.

The achievement of this aim is served also by the fact that the mechanical, natural period of oscillation is large (several seconds) and thus the natural frequency of oscillation is very small, e.g. 0.8 Hz.

The role of the damping system, constituted by the damping spring 7, instrument 8, angular displacement controlling device 9 and hydraulic displacement controlling device 10, is to transform the changes in angular velocity during rotation (start-up, stopping) into an increase or a decrease in the axial tensile force exerted on the spring, by way of (in effect) a paddle system of large pitch angle, whereby to provide portection against external disturbing effects and to assure conditions for the instrument to operate as designed.

Figure 2:
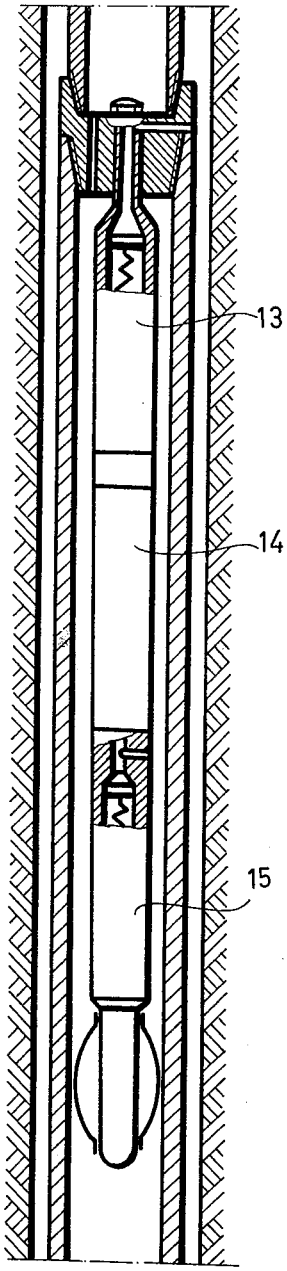
FIG. 2 is a view, partly in elevation and partly in section, of apparatus according to the invention for the simultaneous measurement of a plurality of drilling parameters.
Figure 3:
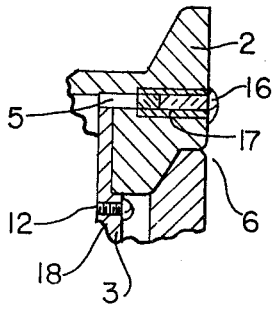
FIG. 3 is a large scale fragmentary sectional view of FIG. 1, showing a detail of the closable bores.

The embodiment shown in FIG. 2 is essentially similar to that of FIG. 1 and shows a combined system for enabling the simultaneous measurement of a plurality of parameters. In this Figure, an instrument 13 is arranged to measure the mud pressure flowing downwardly in the interior of the drilling pipe, an instrument 14 is arranged to measure the mud pressure flowing upwardly in the annular space between the borehole or well and the drilling pipe, while an instrument 15 is arranged to measure the temperature of the mud flowing downwardly in the drilling pipe. This system of measuring may be disposed anywhere in the drilling tool and more than one such system may be mounted in the tool.

We claim as our invention:

1. Apparatus for performing underground measurements during drilling of underground strata using conventional measuring instruments, comprising a closed instrument casing which in use is filled with a hydraulic fluid, an adaptor operable for coupling said casing to the drilling pipe, a spring holder connected to the instrument casing and carrying damping spring means, a member operative for controlling angular displacement and a hydraulic displacement control device, a first bore in the adaptor for permitting mud to flow downwardly around the outside of said casing, a second, closable bore in the adaptor for permitting mud to flow through said casing, a third closable bore in the said casing for communicating external pressure to the interior of the said casing, and means operable for opening and closing said second and third bores in mutually opposite senses.

2. Apparatus according to claim 1 wherein the damping spring means, the said member for controlling angular displacement and the hydraulic displacement control device constitute a unitary composite damping system.

3. Apparatus according to claim 1 wherein said member is a helical plate.

4. Apparatus according to claim 1 wherein the hydraulic displacement control device is a double-acting piston-and-cylinder unit provided with bores, the flow through which in use is controlled by the position of the piston.

5. Apparatus according to claim 1 wherein the said adaptor carries a plurality of separate measuring instruments each of which is provided with its own discrete damping spring means, angular displacement control member and hydraulic displacement control device.

6. Apparatus according to claim 1 wherein said adaptor connects two hollow drilling pipe sections, said instrument casing being secured within the lower pipe section.

* * * * *